US010486871B2

(12) United States Patent
Ramey

(10) Patent No.: US 10,486,871 B2
(45) Date of Patent: Nov. 26, 2019

(54) HANGING CONTAINER LID ASSEMBLY

(71) Applicant: Matt Ramey, Brookline, MA (US)

(72) Inventor: Matt Ramey, Brookline, MA (US)

( * ) Notice: Subject to any disclaimer, the term of this patent is extended or adjusted under 35 U.S.C. 154(b) by 243 days.

(21) Appl. No.: 15/431,923

(22) Filed: Feb. 14, 2017

(65) Prior Publication Data

US 2018/0229905 A1 Aug. 16, 2018

(51) Int. Cl.

| | |
|---|---|
| ***B65D 43/00*** | (2006.01) |
| ***B65D 55/16*** | (2006.01) |
| ***B65D 43/02*** | (2006.01) |
| ***A47G 19/22*** | (2006.01) |

(52) U.S. Cl.

CPC ..... *B65D 55/16* (2013.01); *A47G 19/22* (2013.01); *B65D 43/0208* (2013.01); *B65D 2543/00046* (2013.01); *B65D 2543/00092* (2013.01); *B65D 2543/00268* (2013.01); *B65D 2543/00296* (2013.01); *B65D 2543/00509* (2013.01); *B65D 2543/00537* (2013.01); *B65D 2543/00555* (2013.01); *B65D 2543/00629* (2013.01); *B65D 2543/00685* (2013.01); *B65D 2543/00731* (2013.01); *B65D 2543/00796* (2013.01)

(58) Field of Classification Search

CPC ..... B65D 55/16; B65D 43/0208; B65D 2543/00046; B65D 2543/00092; B65D 2543/00268; B65D 2543/00509; B65D 2543/00537; B65D 2543/00555; B65D 2543/00629; B65D 2543/00685; B65D 2543/00731; B65D 2543/00796; A47G 19/22

USPC ..... 220/379

See application file for complete search history.

(56) References Cited

U.S. PATENT DOCUMENTS

| | | | | |
|---|---|---|---|---|
| 4,589,569 | A | 5/1986 | Clements | |
| 5,050,759 | A * | 9/1991 | Marble | A47G 19/2272 220/603 |
| 5,148,937 | A * | 9/1992 | Huard | B65D 51/223 215/228 |
| 5,799,814 | A * | 9/1998 | Schaefer | B65D 43/0212 220/254.1 |
| 7,175,043 | B2 | 2/2007 | O'Neal | |
| 7,673,767 | B2 * | 3/2010 | Vovan | B65D 21/0237 220/212 |
| 8,079,485 | B2 * | 12/2011 | Berndt | B65D 51/22 215/212 |
| 8,087,530 | B2 * | 1/2012 | Stevens | B29C 45/16 206/541 |

(Continued)

*Primary Examiner* — Ernesto A Grano

(74) *Attorney, Agent, or Firm* — Frost Brown Todd LLC

(57) ABSTRACT

A container lid assembly includes a lid having a body and a flange positioned around a perimeter of the body. The lid assembly further includes a clip having a first end and a second end. The first end of the clip is attached to a bottom surface of the body such that the clip is positioned along the bottom surface of the body within the perimeter of the body. The flange of lid assembly is selectively couplable with the container in a closed configuration such that an opening of the container is covered by the lid assembly. The clip of the lid assembly is selectively couplable with the container in an open configuration by receiving a side wall of the container between the clip and the bottom surface of the body such that at least a portion of the opening of the container is uncovered by the lid assembly.

18 Claims, 4 Drawing Sheets

(56) References Cited

U.S. PATENT DOCUMENTS

| | | | | |
|---|---|---|---|---|
| 8,733,567 | B1 * | 5/2014 | Dopps | B65D 47/36 215/256 |
| 9,125,514 | B1 * | 9/2015 | Rohrer | A47J 36/12 |
| 9,782,029 | B1 * | 10/2017 | FitzSimons | A47G 19/2272 |
| 9,834,346 | B1 * | 12/2017 | Ferraro | B65D 51/223 |
| 10,159,378 | B1 * | 12/2018 | Orban | A47J 36/12 |
| 2004/0245258 | A1 * | 12/2004 | Connors, Jr. | A47G 19/2272 220/713 |
| 2005/0173434 | A1 * | 8/2005 | O'Neal | B65D 43/0212 220/212 |
| 2005/0199663 | A1 * | 9/2005 | Heaton | A45F 5/021 224/269 |
| 2007/0051738 | A1 | 3/2007 | Slayton | |
| 2013/0320018 | A1 * | 12/2013 | Crosby | B65D 41/18 220/345.3 |
| 2016/0007780 | A1 | 1/2016 | Dolan et al. | |

* cited by examiner

HANGING CONTAINER LID ASSEMBLY

BACKGROUND

Typically, lids are used to cover or seal a container to prevent the contents held within the container from spilling. For instance, lids can be used with a drink container, such as a coffee cup, to prevent spilling of a beverage from within the container. In some instances, it is desirable to remove the lid from the container to add contents to the container, such as cream or sugar. It can be difficult to add contents to the container because a user may need to both hold the container and add the contents. This can result in setting the lid down on an unsanitary surface, which can then contaminate the contents of the container. Thus, there remains a need for a lid to hang on a container to more easily and sanitarily add or remove contents from a container.

SUMMARY

The unique solution that addresses the aforementioned need is a hanging container lid assembly as described herein.

A hanging container lid assembly is disclosed that may be used to more easily and/or sanitarily add or remove contents from a container. The hanging container lid assembly is further stackable to allow for more easy storage. A hanging container lid assembly includes a lid having a body and a flange positioned around a perimeter of the body. The lid assembly further includes a clip having a first end and a second end, wherein the first end of the clip is attached to a bottom surface of the body such that the clip is positioned along the bottom surface of the body within the perimeter of the body. The flange of lid assembly is selectively couplable with the container in a closed configuration such that an opening of the container is covered by the lid assembly. The clip of the lid assembly is selectively couplable with the container in an open configuration by receiving a side wall of the container between the clip and the bottom surface of the body such that at least a portion of the opening of the container is uncovered by the lid assembly.

These and other embodiments of the hanging container lid assembly are set forth in greater detail below.

BRIEF DESCRIPTION OF THE DRAWINGS

It is believed that the present invention will be better understood from the following description of certain examples taken in conjunction with the accompanying drawings, in which like reference numerals identify like elements.

Figures 1, 2:
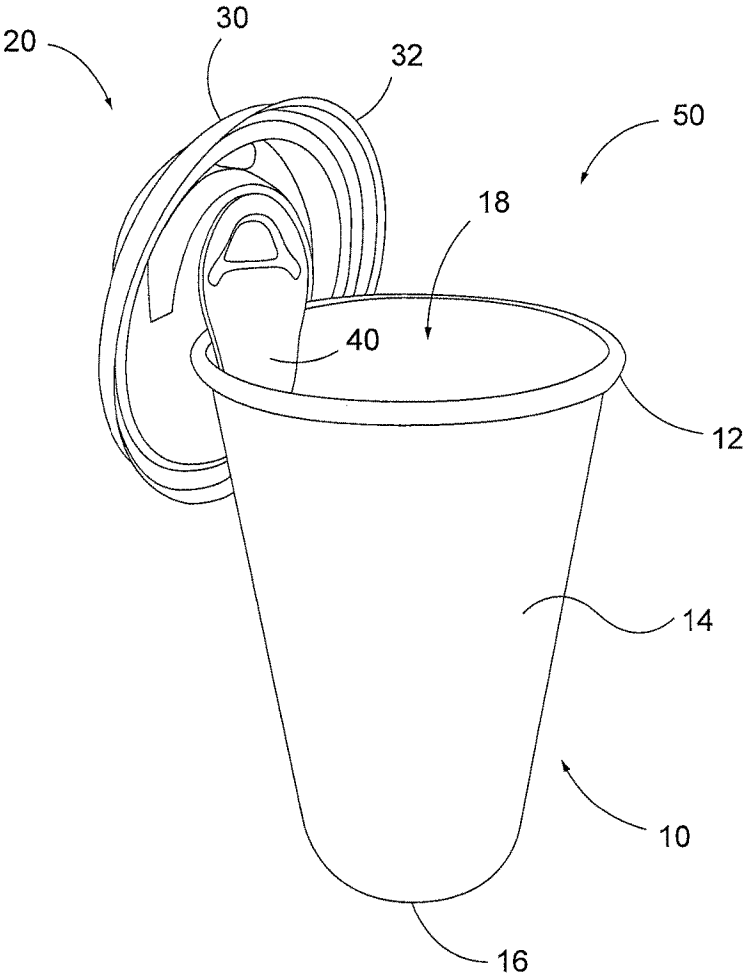
FIG. 1 is a top perspective view of a container assembly with a lid assembly coupled to a container in an open configuration.
FIG. 2 is a top perspective view of the container assembly of FIG. 1 with the lid assembly coupled to the container in a closed configuration.

The drawings are not intended to be limiting in any way, and it is contemplated that various embodiments of the present disclosure may be carried out in a variety of other ways, including those not necessarily depicted in the drawings. The accompanying drawings incorporated in and forming a part of the specification illustrate several aspects of the present disclosure, and together with the descriptions serve to explain the principles and concepts of the present disclosure; it being understood, however, that the present disclosure is not limited to the precise arrangements shown.

DETAILED DESCRIPTION

The following description and embodiments of the present disclosure should not be used to limit the scope of the present disclosure. Other examples, features, aspects, embodiments, and advantages of the present disclosure will become apparent to those skilled in the art from the following description. As will be realized, the present disclosure may contemplate alternate embodiments than those exemplary embodiments specifically discussed herein without departing from the scope of the present disclosure. Accordingly, the drawings and descriptions should be regarded as illustrative in nature and not restrictive.

"Container" as used herein, means a device for holding beverages and/or food. Non-limiting examples of containers may be selected from the group of: cups; mugs; bowls; sippy cups; Tupperware; and combinations thereof. The containers can hold beverages, such as coffee, tea, milk, juice, soda, or other liquids, as well as other types of food.

FIGS. 1 and 2 show a container assembly (50) comprising a container (10) and a lid assembly (20). The container (10) is configured to hold a beverage and/or food. In the illustrated embodiment, the container (10) comprises a bottom (16), a side wall (14) extending upwardly from the bottom (16), and a flange (12) positioned along the perimeter of the top of the side wall (14). It should be noted that the flange (12) is merely optional. The side wall (14) defines an opening (18) at the top of the container (10), wherein contents may be added and/or removed from the container (10). The container (10) can be disposable or reusable, and can be made from paper, cardboard, plastic, or any other suitable material. The container (10) can be any suitable shape, such as circular, oval, square, rectangular, etc. Still other suitable configurations for container (10) will be apparent to one with ordinary skill in the art in view of the teachings herein.

The lid assembly (20) is selectively couplable with the container (10). For instance, the lid assembly (20) is selectively couplable with the container (10) in a first open configuration, as shown in FIG. 1. In this configuration, the lid assembly (20) rests on the side wall (14) of the container (10) such that the opening (18) of the container (10) is accessible. This allows a user to more easily add and/or remove contents from the container (10) without setting the lid assembly (20) on an unsanitary surface. The lid assembly (20) is also selectively couplable with the container (10) in a second closed configuration, as shown in FIG. 2. In this configuration, the lid assembly (20) is attached to the flange (12) of the container (10) such that the opening (18) of the container (10) is covered or sealed. This may prevent the contents of the container (10) from spilling.

Figure 3:
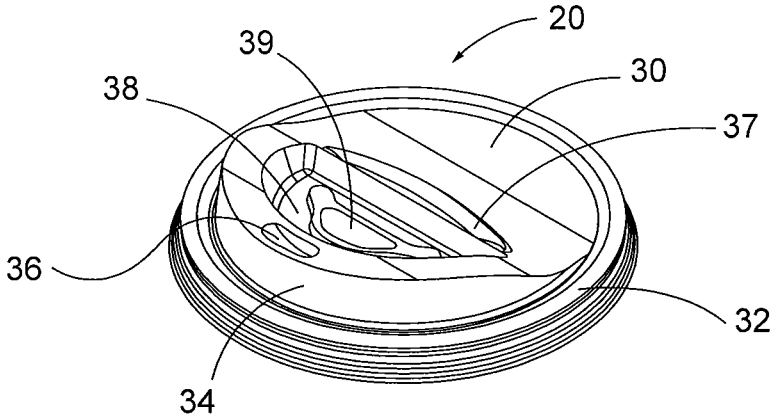
FIG. 3 is a top perspective view of the lid assembly of FIG. 1.
Figure 4:
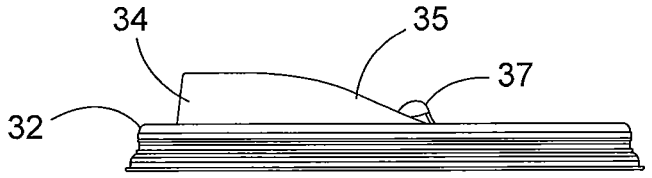
FIG. 4 is a side elevational view of the lid assembly of FIG. 1.
Figure 6:
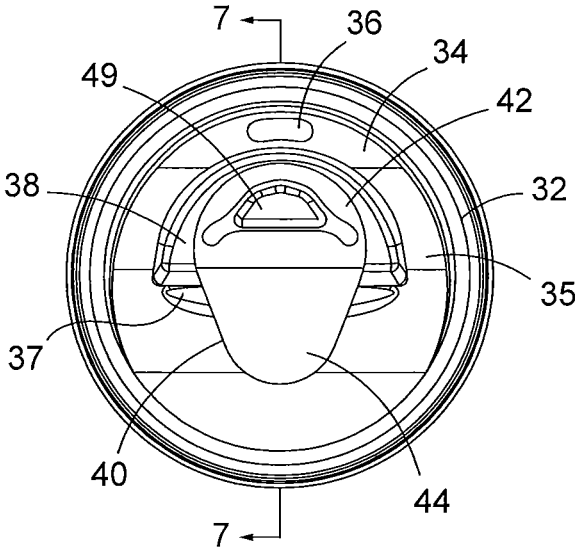
FIG. 6 is a bottom plan view of the lid assembly of FIG. 1.
Figure 7:
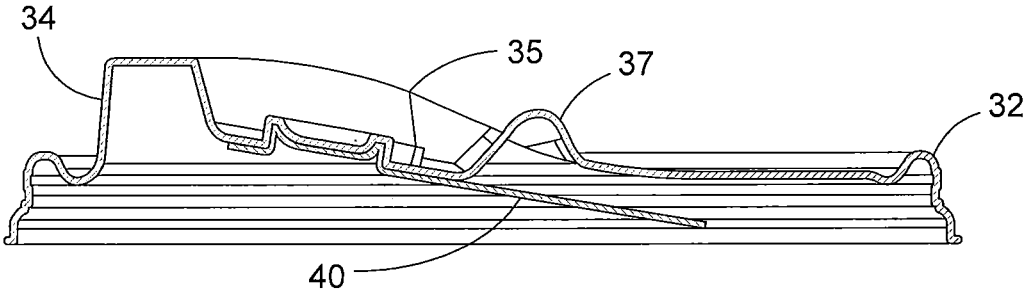
FIG. 7 is a cross-sectional view of the lid assembly of FIG. 1 taken along line 7-7 of FIG. 6.
Figure 8:
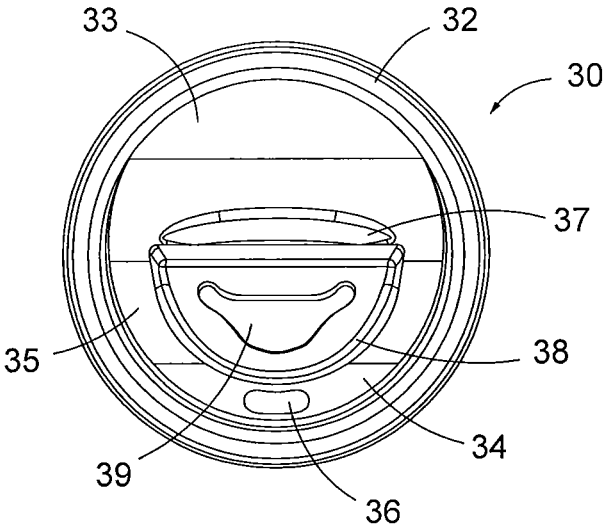
FIG. 8 is a bottom plan view of a lid of the lid assembly of FIG. 1.

The lid assembly (20) is shown in more detail in FIGS. 3-7. The lid assembly (20) comprises a lid (30) and a clip (40) positioned on a bottom surface of the lid (30). As best seen in FIGS. 3-4 and 8, the lid (30) comprises a flange (32) positioned around a perimeter of the lid (30) such that it is sized and shaped to correspond to the flange (12) of the container (10). Accordingly, the flange (32) of the lid (30) is configured to snap onto the flange (12) of the container (10) to thereby selectively couple the lid (30) to the container (10) in the closed configuration. In some instances, the flange (32) of the lid (30) is coupled directly to the side wall (14) of the container (10). The lid (30) further comprises a protrusion (34) extending upwardly from the lid (30). An opening (36) is positioned on the protrusion (34). The opening (36) on the protrusion (34) thereby allows a user to position his or her mouth around the protrusion (34) and drink the contents of the container (10) through the opening (36) of the lid (30) when the lid (30) is coupled with the container (10) in the closed configuration. The protrusion (34) further comprises a contoured surface (35) that ramps downward to the lower surface (33) of the lid (30). Such a contoured surface (35) can allow multiple lid assemblies (20) to be stacked on top of each other more easily.

Referring to FIG. 3, the lid (30) comprises a recess (38) adjacent to the protrusion (34). The recess (38) is positioned inward relative to the protrusion (34). As best seen in FIG. 7, the recess (38) is angled downward away from the protrusion (34), but it should be noted that this is merely optional. The recess (38) comprises a tab (39) extending upward within the recess (38). The tab (39) comprises a winged shaped, through other suitable shapes can be used. The tab (39) is configured to receive the clip (40), as will be discussed in more detail below. Referring to FIG. 4, adjacent to the recess (38) is a lip (37) projecting upward relative to the recess (38). The lip (37) is sized and shaped to receive the flange (12) of the container (10) when the lid assembly (20) is positioned in the open configuration on the container (10). In the illustrated embodiment, the lip (37) is curved and extends transversely across the lid (30), but the lip (37) can be any other suitable shape. It should be noted that the lip (37) is merely optional.

Figure 9:
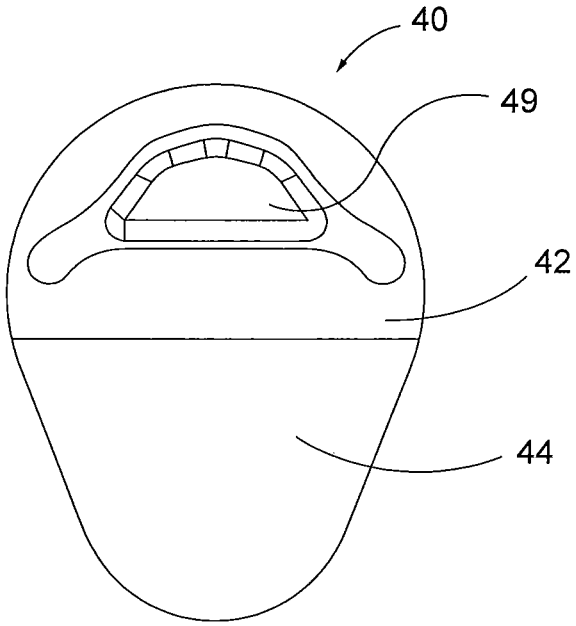
FIG. 9 is a bottom plan view of a clip of the lid assembly of FIG. 1.
Figure 10:
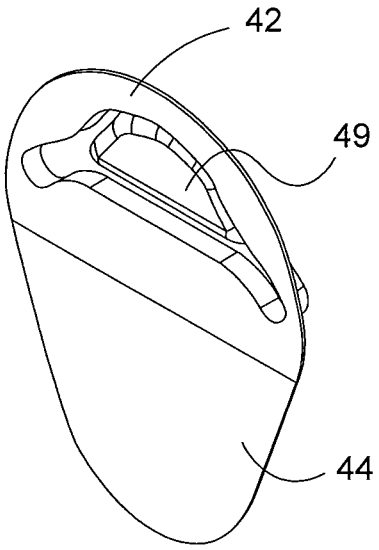
FIG. 10 is a bottom perspective view of the clip of FIG. 9.
Figure 11:
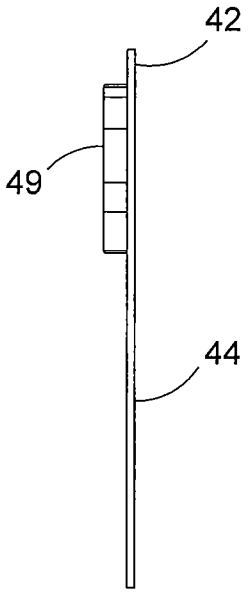
FIG. 11 is a side elevational view of the clip of FIG. 9.

The clip (40) is coupled to the bottom surface of the lid (30). FIGS. 9-11 show the clip (40) in more detail. The clip (40) comprises a first end portion (42) and a second end portion (44). The first end portion (42) of the clip (40) comprises a circular shape corresponding to the recess (38) of the lid (30), but any other suitable shape can be used. The first end portion (42) of the clip (40) comprises a tab (49) extending upward from the first end portion (42). The tab (49) is sized and shaped to correspond to the tab (39) of the lid (30) to thereby insert within the tab (39) of the lid. In the illustrated embodiment, the tab (49) is winged shaped, but any other suitable shape can be used. The winged shape of the tab (49) may prevent the clip (40) from rotating relative to the lid (30) when the tab (49) of the clip (40) is inserted within the tab (39) of the lid (30). The second end portion (44) of the clip (40) extends from the first end portion (42) and is tapered such that a width of the second end portion (44) decreases along the length of the second end portion (44).

Figure 5:
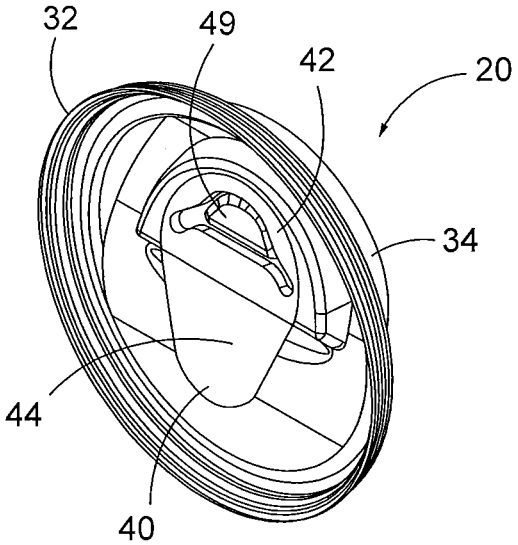
FIG. 5 is a bottom perspective view of the lid assembly of FIG. 1.

As best seen in FIGS. 5-7, the first end portion (42) of the clip (40) is secured to the bottom surface of the lid (30) by inserting the tab (49) of the clip (40) into the tab (39) of the lid (30) such that the first end portion (42) of the clip (40) abuts the bottom surface of the recess (38) of the lid (30). The clip (40) and the lid (30) can be attached by adhesive, welding, etc. In some versions, the clip (40) is integral with the lid (30). The clip (40) thereby extends along the bottom surface of the lid (30) within the perimeter of the lid (30). This may allow for easier stacking of multiple lids (30). The second end portion (44) of the clip (40) is detached from the lid (30). The angled configuration of the recess (38) of the lid (30) thereby angles the second end portion (44) of the clip (40) away from the bottom surface of the lid (30).

Accordingly, the lid assembly (20) can be selectively coupled to the container (10) in an open configuration, as shown in FIG. 1, by sliding the lid assembly (20) onto the side wall (14) of the container (10) such that the side wall (14) of the container (10) is positioned between the clip (40) and the bottom surface of the lid (30). The tapered and angled configuration of the second end portion (44) of the clip (40) may allow for easier insertion of the side wall (14) of the container (10) between the clip (40) and the lid (30). The lid assembly (20) can be slid downward onto the side wall (14) of the container (10) until the flange (12) of the container (10) is aligned with the lip (37) of the lid (30) such that the flange (12) protrudes into the lip (37). In this open configuration, a user can more easily add and/or remove contents from the container (10) without setting the lid assembly (20) on an unsanitary surface. The lid assembly (20) is also sufficiently secure on the container (10) that a user is able to drink from the container (10) with the lid assembly (20) selectively coupled to the container (10) in the open configuration.

The lid assembly (20) can be disposable or reusable, and can be made from paper, cardboard, plastic, or any other suitable material. The lid assembly (20) can be any suitable shape, such as circular, oval, square, rectangular, etc. Still other suitable configurations for the lid assembly (20) will be apparent to one with ordinary skill in the art in view of the teachings herein.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

I claim:

1. A lid assembly for a container comprising:

(a) a lid having a body and a flange positioned around a perimeter of the body; and (b) a clip having a first end and a second end, wherein the first end of the clip is coupled in a parallel relationship to a bottom surface of the body such that the clip is positioned along the bottom surface of the body within the perimeter of the body, wherein the second end of the clip extends away from the first end of the clip to form a space between the second end of the clip and the bottom surface of the body;

wherein the flange of lid assembly is selectively couplable with the container in a closed configuration such that an opening of the container is covered by the lid assembly; and wherein the clip of the lid assembly is selectively couplable with the container in an open configuration by receiving a side wall of the container between the clip and the bottom surface of the body such that at least a portion of the opening of the container is uncovered by the lid assembly.

2. The lid assembly of claim 1, wherein the lid comprises a protrusion extending upwardly from the body.

3. The lid assembly of claim 2, wherein the lid comprises an opening positioned on the protrusion.

4. The lid assembly of claim 2, wherein the lid comprises a contoured surface that ramps from the protrusion downward to a lower surface of the lid.

5. The lid assembly of claim 1, wherein the lid comprises a recess positioned inward from the body of the lid.

6. The lid assembly of claim 5, wherein the recess is angled downward relative to the body of the lid.

7. The lid assembly of claim 1, wherein the lid comprises a first tab extending upward from the body of the lid.

8. The lid assembly of claim 7, wherein the clip comprises a second tab extending upward from the clip, wherein the second tab is attached to the first tab.

9. The lid assembly of claim 8, wherein the first and second tabs comprise a winged shape.

10. The lid assembly of claim 1, wherein the lid comprises a lip projecting upward from the body of the lid.

11. The lid assembly of claim 1, wherein the clip is tapered along a length of the clip such that the second end of the clip has a smaller width than the first end of the clip.

12. The lid assembly of claim 1, wherein the second end of the clip is angled away from the bottom surface of the lid.

13. The lid assembly of claim 1, wherein a first lid assembly is stackable on top of a second lid assembly.

14. A lid assembly for a container comprising:

(a) a lid having a body and a flange positioned around the perimeter of the body, wherein a portion of a bottom surface of the body is angled; and (b) a clip having a first end and a second end, wherein the clip is substantially flat, wherein the first end of the clip is coupled to the angled portion of the bottom surface of the body such that the second end of the clip extends to form a space between the second end of the clip and the bottom surface of the body.

15. A container assembly comprising:

(a) a container comprising a side wall defining an opening and a flange positioned along a perimeter of the top of the side wall;

(b) a lid assembly comprising:

(i) a lid having a body and a flange positioned around a perimeter of the body, wherein the lid comprises a lip projecting upward from the body, and (ii) a clip having a first end and a second end, wherein the first end of the clip is attached to a bottom surface of the body such that the clip is positioned along the bottom surface of the body within the perimeter of the body such that the extending second end of the clip is spaced below the lip of the lid;

wherein the lid assembly is selectively coupled with the container in a first closed configuration such that the flange of the lid assembly is positioned on the flange of the container to cover the opening of the container with the lid assembly; and wherein the lid assembly is selectively coupled with the container in a second open configuration such that the flange of the container is received within the lip of the lid such that the side wall of the container is positioned between the clip and the bottom surface of the body such that at least a portion of the opening of the container is uncovered by the lid assembly.

16. The container assembly of claim 15, wherein the lid comprises a lip projecting upward from the body of the lid, wherein the lip is configured to receive the flange of the container when the lid assembly is selectively coupled with the container in the second open configuration.

17. The container assembly of claim 15, wherein the clip is tapered along a length of the clip such that the second end of the clip has a smaller width than the first end of the clip.

18. The container assembly of claim 15, wherein the second end of the clip is angled away from the bottom surface of the lid.

* * * * *